United States Patent [19]

Bell et al.

[11] Patent Number: 4,604,497

[45] Date of Patent: Aug. 5, 1986

[54] ELECTRICAL CONDUCTOR FOR TELECOMMUNICATIONS CABLE

[75] Inventors: John M. Bell, Seeley's Bay; Peter J. Schmidt, Gananoque, both of Canada

[73] Assignee: Northern Telecom Limited, Montreal, Canada

[21] Appl. No.: 707,765

[22] Filed: Mar. 4, 1985

Related U.S. Application Data

[63] Continuation-in-part of Ser. No. 518,059, Jul. 28, 1983, abandoned, which is a continuation of Ser. No. 253,312, Apr. 13, 1981, abandoned.

[51] Int. Cl.[4] ..... H01B 7/02

[52] U.S. Cl. ..... 174/110 F; 174/36; 174/110 PM; 174/116; 174/113 R

[58] Field of Search ..... 174/110 F, 23 R, 23 C, 174/25 C, 36, 102 R, 107, 110 PM, 116, 117 F, 113 R

[56] References Cited

U.S. PATENT DOCUMENTS

| | | | |
|---|---|---|---|
| 2,805,276 | 9/1957 | Weitzel | 174/110 F |
| 3,936,591 | 2/1976 | Smith et al. | 174/110 F X |
| 4,058,669 | 11/1977 | Nutt et al. | 174/27 X |
| 4,174,236 | 11/1979 | Dougherty et al. | 174/110 F X |
| 4,368,350 | 1/1983 | Perelman | 174/110 F |

FOREIGN PATENT DOCUMENTS 1100819 1/1968 United Kingdom ..... 174/110 F

OTHER PUBLICATIONS

E. D. Metcalf, Cellular Insulation as an Answer to Material Conservation, Conf. Proc. of the 23 th International Wire & Cable Symp., Atlantic City, N.J. Dec. 1974, pp. 53 to 58.

Dean et al., A Report on the Further Progress Made in the Application of Cellular Plastics to Telephone Cable Design and Manufacture, Conf. Proc. of the 18 th International Wire and Cable Symp., Atlantic City, N.J., Dec. 1969, pp. 1 to 19.

*Primary Examiner*—R. R. Kucia

*Attorney, Agent, or Firm*—R. J. Austin

[57] ABSTRACT

Insulated electrical conductor for telecommunications cable in which two layers of insulation are provided. The inner of the two layers is a solid non-cellular construction and the outer layer is cellular. The nominal mutual capacitance between the conductor and an identical conductor is at a desired nominal value of 83 nanofarads/mile value between conductors above a desired minimum value while having an outside diameter across the insulation which is less than for a conductor of the same gauge which provides the same mutual capacitance and has a solid insulation of the same material as the inner layer.

4 Claims, 4 Drawing Figures

ELECTRICAL CONDUCTOR FOR TELECOMMUNICATIONS CABLE

This application is a continuation-in-part of U.S. patent application Ser. No. 518,059, filed July 28, 1983, now abandoned, which was a continuation of U.S. patent application Ser. No. 253,312 filed Apr. 13, 1981, now abandoned.

This invention relates to an insulated electrical conductor for telecommunications cable.

Telecommunications cables conventionally comprise a plurality of individually insulated conductors, usually twisted together in pairs, the conductors forming a core encased in a cable sheath. In "air-core" polyolefin insulated cables, i.e. those not filled, a conventional cable used commercially in North America has an insulation consisting of solid non-cellular polymeric material.

Interstices exist between the insulated conductors. If perforations are present or are otherwise formed in the sheath e.g. due to lightning or mechanical damage, it is possible in certain applications for moisture entering the cable to reach these interstices and to fill them for long distances along the cable by migration. The presence of this moisture degrades the electrical performance of the cable and may even cause short circuits between conductors when pinholes or other defects are present in the individual insulation of the conductors. The moisture acts as an electrolyte to lead to corrosion of exposed metal surfaces directly or by facilitating galvanic action.

In view of all these problems, for instance for buried cable, the interstices between conductors in cable cores have been filled with a water repellant and water impermeable medium such as grease or petrolatum jelly. Such filled cables will be referred to in this specification as "grease filled" cables.

Known filling materials all have a permittivity greater than 1 which is the permittivity of air. Hence, displacement of the air from between the insulated conductors by these filling materials affects the electrical characteristics and thus telecommunication characteristics compared to air-core cable. For instance, in grease filled cables, these changes are in some respects deleterious in that the filling materials increase the capacitance between adjacent conductors, but it is also found that the grease advantageously increases the dielectric strength of the insulation. As is known, cables are designed to provide a certain nominal mutual capacitance between coordinates. This is a nominal 83 nanofarads/-mile.

Originally, the problem of increase in capacitance with grease filled cable was overcome by an increase in the thickness of the individual solid insulation on the conductors, but this resulted in an increase in the amount of insulation material required over that for air-core cable and hence an increase in cable diameter which is undesirable for cost and installation reasons.

The above further problem of increase in the amount of insulation material and cable diameter has been overcome by an invention described in Canadian Pat. No. 952,991. In this patent, there is described a communication cable having a grease filled core of a plurality of insulated conductors, the insulation on each conductor being a dual layer structure comprising an inner layer of cellular polymeric material and a relatively thin outer layer of solid polymeric material. The cellular polymeric material has the advantage that it has a lower permittivity than solid non-cellular materials and is adjacent to the conductor to retain the capacitance down to a nominal 83 nanofarads/mile. This also results in a saving in materials in replacing solid material with cellular material and the overall diameter of each insulated conductor is reduced, thereby advantageously reducing the outside cable diameter for grease filled cable. In an example given in Canadian Pat. No. 952,991, the inner layer of cellular insulation, on 22 AWG aluminum conductor, has a thickness of 9 mils with 40% of its volume being air, and the outer solid layer has a thickness of 2.5 mils, the overall diameter of the insulated conductor being approximately 48 mils. The dielectric strength between conductors is held at acceptable levels mainly by the combined dielectric properties of the outer solid layer and the surrounding filling material in the core both of which are exterior to the cellular layer. While the dual layer structure has been useful to reduce the outside diameter of the insulation and provide an acceptable dielectric strength in filled cable, no construction has yet been found as an alternative to conventional air-core cable and which provides dielectric stengths comfortably above the minimum strengths recommended by the Rural Electrification Administration (R.E.A.) in North America. For commercial reasons, it is advisable to produce cable which will operate above these requirements.

The dual layer structure of Canadian Pat. No. 952,991 would not provide dielectric breakdown requirements set by the R.E.A. if used in air-core cable because the avoidance of grease would greatly reduce the dielectric strength. Such poor results would be obtained with an outside diameter of 48 mils for 22 AWG which is greater than a conventionally insulated conductor of less than 45 mils in air-core cable and which provides commercially acceptable levels of nominal capacitance and dielectric strength. Also, with this dual layer structure, the nominal mutual capacitance would be above the 83 nanofarads/mile accepted by the industry.

The only way of providing the required nominal mutual capacitance of 83 nanofarads/mile for air-core cable with this dual layer construction while advantageously reducing the outside diameter of the insulation is to provide a thicker outer layer of solid material and a thinner inner layer of cellular material. In one resulting construction, the outside diameter of the insulation of the dual layer would be around 2% less than the outside diameter of the conventional solidly insulated conductor. However, the thickness of solid insulation in the dual layer construction would be about two thirds of the total thickness whereby there would be very little material savings with the use of the inner cellular layer. In view of this and the fact that the dielectric strength of the dual layer structure would be exceedingly low compared with the conventional solid construction, there would be little merit in using the dual layer structure for air-core cable. Similar disadvantages would also be found with a structure of insulated conductor having an inner cellular layer and an outer solid layer as described in U.S. Pat. No. 4,058,669, entitled "Transmission Path Between Nearby Telephone Central Offices" and granted on Nov. 15, 1977 to W. G. Knott and G. H. Webster.

In another structure which has been suggested for grease filled cable, the conventional solid insulation is replaced completely by a single layer of cellular material. In this structure, the diameter of the insulation on each conductor is less than that of the conventional solid insulation while providing the same nominal mutual capacitance between conductors. The dielectric strength is brought up to acceptable levels in this wholly cellular insulation structure by the presence of grease between insulated conductors.

If used in air-core cable, the all cellular insulation structure would still require a smaller outside diameter than conventional solid insulation to provide the same nominal mutual capacitance. However, this smaller diameter also results in an extremely low dielectric strength which would be unacceptable under R.E.A. standards. In one suggested construction of air-core cable as referred to in British Pat. No. 1,100,819, foam or cellular plastic insulation is used on a conductor. This construction would not provide a nominal mutual capacitance between conductors of 83 nanofarads/mile together with a dielectric strength capable of providing a dielectric breakdown between conductors significantly above the minimum set by R.E.A. This construction however is in keeping with the dielectric breakdown requirements in Europe which are below those of R.E.A. standards. In support of this, the Applicant refers to a paper entitled "A Report On The Further Progress Made In The Application Of Cellular Plastics To Telephone Cable Design and Manufacture" by N. S. Dean, B. J. Wardly and J. R. Walters and given at proceedings of the 18th International Wire & Cable Symposium, Atlantic City, N.J., U.S.A. in 1969. In that paper, an unfilled or air-core cable is described in which the conductor insulation is blown cellular polyethylene. Table 3 of the paper shows the "H.V. withstand" (for dielectric breakdown) mean value as 3.4 Kv d.c. for 28 AWG conductor and 4.0 Kv d.c. for 26 AWG conductor with minimum values of 1.2 and 1.4 Kv d.c. In contrast to this, the minimum breakdown voltage from conductor to conductor in air-core cable as recommended by the R.E.A. is 2.4 Kv d.c. for 26 AWG. A conventional solid insulated 26 AWG conductor pair for air-core cable will provide far in excess of this minimum breakdown value in North America and it is normal for the conductor to conduct or average breakdown to be in the region of or above 30 Kv d.c.

British Pat. No. 1,100,819 refers to the use of an adhesive layer beneath the cellular structure on the conductors. The thickness of this layer is as minimal as possible and is recorded therein as being approximately 20$\mu$ (0.00078 inches). The prior patent states that this produces a slight change in electrical transfer properties compared to all foam insulation to change the outside diameter of the insulation to 0.975 of the original diameter. Thus this construction with the use of the adhesive could not satisfy the R.E.A. recommended breakdown voltages from conductor to conductor. It is also questionable whether it is feasible to produce a substantially constant thickness coat of 20$\mu$. It would appear that such a thin layer would result in areas of conductor completely lacking in the adhesive whereby "any slight change in electrical transfer properties" as stated by the patent would be completely nullified.

In another patent, U.S. Pat. No. 4,368,350 granted Jan. 11, 1983 to R. D. Perelman, a cable is described in which only a single conductor is used. This conductor is of a gauge heavier than would be used within the core of a multiconductor telecommunications cable, i.e. it has an outside diameter of 0.185 inches. It has a covering layer of adhesive up to 0.004 inches thick which is covered by a foam layer of 0.165 inches thick. The cell size in the foam lies between 10 and 40 mils. Because of its structure, the Perelman cable has a completely different set of electrical requirements from a conventional multiconductor cable. Such an insulated conductor is completely unsuitable for use in multiconductor cable in which the maximum conductor diameter is of the order of 0.035 inches with an outside diameter over the conductor insulation of 0.078 inches. Apart from this the adhesive is acknowledged by Perelman to contribute to the insulation loss of the cable.

Hence, apart from the conventional solid non-cellular insulation, no insulation has been found which will provide dielectric strengths from conductor to conductor in air-core cable and which lie significantly above the minimum requirements set by the R.E.A.

The present invention provides an air core cable which, for a nominal mutual capacitance of 83 nanofarads/mile provides a dielectric strength between conductors which is completely above the minimum reqirement set by R.E.A. while having an insulation on each conductor which is different from the conventional non-cellular insulation. The cable of this invention is not only an alternative to one with conventional solid insulation, but also provides its dielectric strength requirements with an outside diameter of insulation which is reduced significantly below that for conventional solid insulation thus enabling more twisted conductor pairs to be included in a cable of a certain outside diameter. Because of its structure, the cable according to the invention also produces savings in materials in relation to a conventional air-core cable.

The present invention provides a telecommunications cable having an air-core in which a plurality of insulated electrical conductors are provided, each of which comprises a conductor of diameter between 0.0126 inches and 0.0360 inches having insulation comprising an unpigmented inner layer of solid non-cellular polyolefin based composition of at least 2 mils thick, and an outer layer of cellular polyolefin based composition wherein the cells provide an air space which is at least 15% of the total volume of the outer layer and wherein the nominal mutual capacitance between conductors is at 83 nanofarads/mile and a predetermined minimum dielectric breakdown value between conductors is obtained, the maximum outside diameter across the insulation being less than that of an electrical conductor of equal conductor diameter which provides the same nominal mutual capacitance with a solid non-cellular insulation of the same material as said inner layer.

As referred to above, the nominal capacitance of 83 nanofarads/mile is intended to cover any cable which is manufactured to achieve this capacitance value but which varies therefrom between acceptable manufacturing limits, say between 79 and 87 nanofarads/mile.

The above invention is based upon the realization that a combination of various features will provide the required mutual capacitance and desirable dielectric breakdown value with the insulation on the conductors having the advantage of an outside diameter which is less than that for solid non-cellular insulation on conductors of the same gauge. It is insufficient for the purposes of the invention therefore, merely that the inner layer is solid and non-cellular and the outer layer is cellular. This realization is achieved with the solid material in the greatest intensity position of the electromagnetic field to enable the inner layer to be most effective against dielectric breakdown coupled with sufficient thickness to provide a commercially acceptable dielectric breakdown level in excess of the minimum R.E.A. recommendations. With this thickness of the non-cellular inner layer, the outer layer will complete the total structure with the required nominal mutual capacitance while, remarkably, retaining the outside diameter not only below that of the conventional solidly insulated conductor, but also at a diameter the smallness of which cannot be achieved with any other insulated conductor to produce the same requirements.

In preferred constructions, the air space volume in the total volume of the cellular layer in the construction according to the invention is at least 25% whereby significant savings in materials may be obtained over materials required for conventionally insulated conductors in air-core cable. However, the air space volume to be chosen is open to experimentation to provide a desired outside diameter to the insulation for mutual capacitance purposes when the thickness of the inner layer has been chosen.

One embodiment of the invention will now be described, by way of example, with reference to the accompanying drawings in which.

Figure 1:
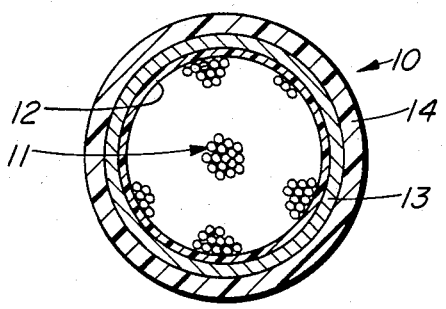
FIG. 1 is a cross-sectional view through a telecommunications cable.

In the embodiment now to be described, specific dimensions of conductor and insulation layers will not be referred to. Dimensions will be discussed at the end of the description for different gauges of conductor to enable comparisons to be made between the dielectric strength and capacity values of constructions of the embodiment and other insulated conductors not within the scope of this invention.

In the embodiment, a telecommunications cable 10 comprises a core having a plurality of pairs of individually insulated conductors 11. The core is wrapped in a composite wrap comprising an inner layer 12 of plastic tape, e.g. 3 mils thick, such as "Mylar" tape. The inner layer may comprise other materials such as paper or polyethylene or combinations of these materials. Around this is another layer 13 of aluminum tape, e.g. 8 mils thick which has been coated on both sides with polyethylene, followed by a medium density block polyethylene outer layer 14 of about 80 mils thickness.

Figure 2:
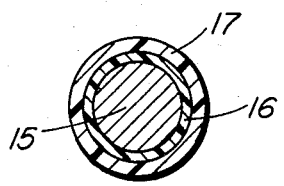
FIG. 2 is a cross-sectional view of an insulated conductor incorporated in the cable.

The core, commonly referred to as an air-core, has each insulated conductor 11 of each pair constructed in the manner shown in FIG. 2. Each insulated conductor comprises a conductor 15 covered by an inner layer 16 of solid non-cellular insulating material which in line with this invention has a minimum thickness of 2 mils. This may be made from any suitable electrically insulating plastics material such as a polyolefin, e.g. polypropylene or medium density polyethylene. An outer layer 17 enclosing the inner layer is also a polyolefin, which is specifically cellular polypropylene which is preferably closed cell but may be of open cell structure. Alternatively, the inner layer and outer layer are both formed from high density polyethylene with the outer layer, of course, being cellular.

The insulated conductor is manufactured by passing conductor through a two-stage extruder (not shown), the first stage providing the inner non-cellular insulating layer 13 and the second stage extruding the cellular layer. The cellular layer is formed by normal foam extrusion techniques.

It is found that while the cells expand directly after extrusion, expansion of the outer layer is outwardly from the inner layer and has no effect upon the inner layer which has just been extruded. Thus the inner layer is not stressed by its contact with the expanding outer layer and there is no likelihood of pinholes being formed in the inner layer because of stress build-up.

The thickness of each of the layer 13, 14 is predetermined primarily to give a desired nominal mutual capacitance value of 83 nanofarads/mile in the completed cable. Also to give the required dielectric properties, the inner layer is located at the position of greatest field intensity and its thickness is calculated to give satisfactory dielectric strength and thus to enable the outer cellular layer to lie as close as possible to the conductor so as not to detract from the required mutual capacitance.

Further, the material of the outer layer may be pigmented without detracting from the mutual capacitance properties unduly. While it is known that pigmentation may deleteriously affect the dielectric strength properties of an insulating layer, the inner layer is not pigmented and thus its dielectric strength is not so affected.

Figure 3:
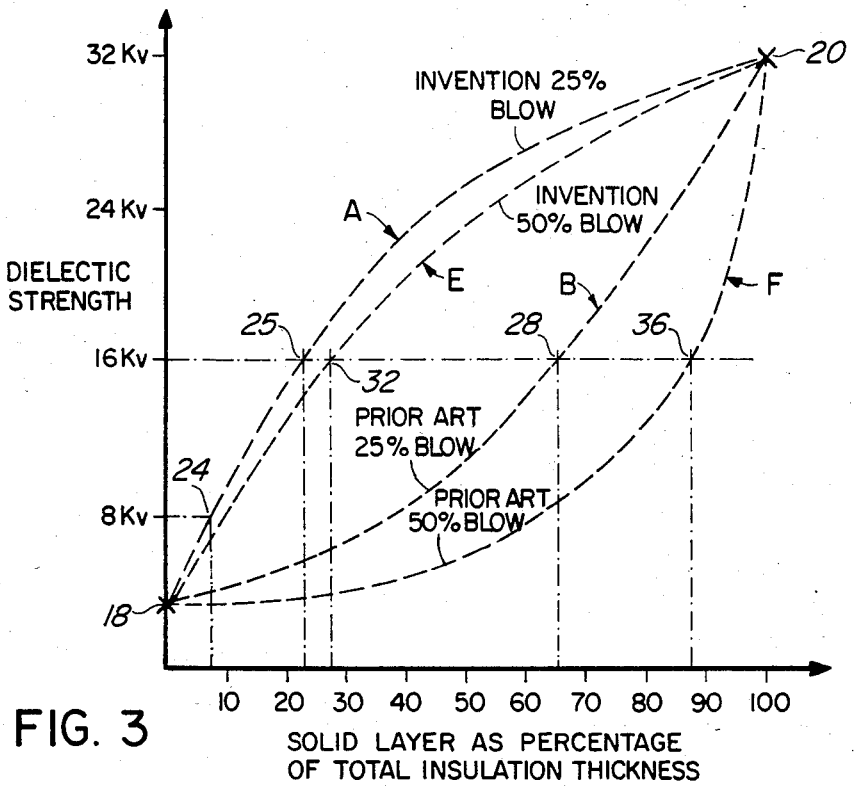
Figure 4:
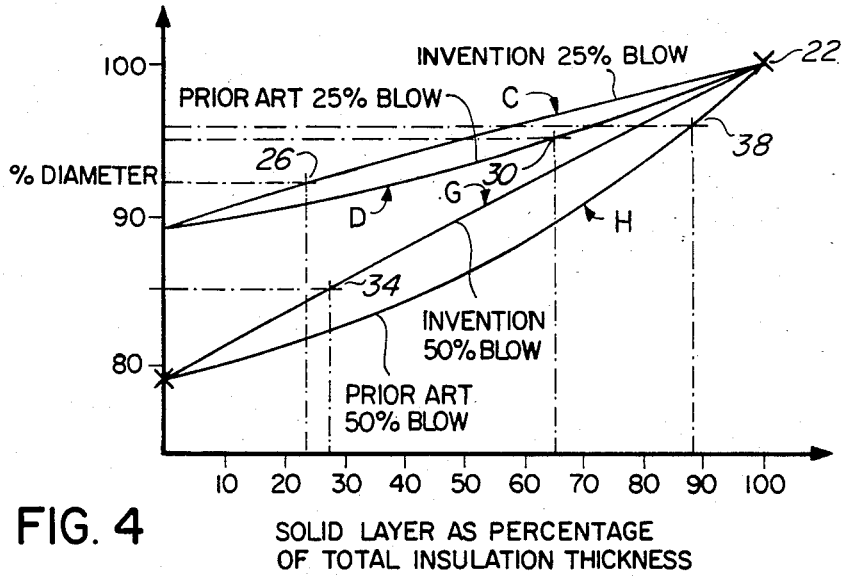

FIGS. 3 and 4 are graphs showing comparisons between various constructional aspects and properties of (a) an insulated 22 AWG conductor forming part of an air-core cable according to the invention and (b) an insulated 22 AWG conductor of an air-core cable and in which two plastic insulation layers are used with the inner layer being cellular and the outer layer being non-cellular i.e. solid. This latter type of insulation is that referred to in U.S. Pat. No. 4,058,669, entitled "Transmission Path Between Nearby Telephone Central Offices" and granted on Nov. 15, 1977 to W. G. Knott and G. H. Webster. The characteristics of all graphs in FIGS. 3 and 4 satisfy the basic requirement of obtaining a nominal mutual capacitance between conductors of 83 nanofarads/mile.

FIG. 3 shows characteristics of curves in which parameters are dielectric strength between conductors and thickness of the solid layer as a percentage of the total insulation thickness. The dielectric strength is determinable by the test procedure described hereunder and with reference to Table 1. The horizontal axis represents the solid layer as a percentage of total insulation thickness.

In an insulated conductor having an inner solid layer and outer cellular layer as used in the inventive cable and 25% of the volume of the outer layer being air (referred to as "% blow"), then to achieve 83 nanofarads/mile nominal mutual capacitance, the dielectric strength between conductors increases according to the characteristic of curve 'A' (FIG. 3), as the thickness of the solid layer increases as a percentage of the total insulation thickness. The lower end 18 of the curve represents a single layer of cellular insulation on a conductor, i.e. having a zero percent solid layer. The upper end 20 of the curve represents a single 100% solid layer. In contrast to this, in a conductor having a two layer structure with the outer layer being solid material and the inner layer being cellular with a 25% blow, then the dielectric strength between conductors increases according to the characteristic of curve 'B' in FIG. 3 as the thickness of the solid layer increases as a percentage of the total insulation thickness.

FIG. 4 is also representative of the basic criteria of 83 nanofarads/mile. Curve 'C' shows the increase in diameter of the total insulation as the solid layer increases as a percentage of total insulation thickness for the insulated conductor construction which produced the characteristic of curve 'A'. This diameter increase is shown as a percentage of the outside diameter of a single layer of solid insulation upon 22 AWG conductor. This is the upper point 22 of the curve for the nominal dielectric strength of a 22 AWG solidly insulated conductor.

Curve 'D' in FIG. 4 is similar to curve 'C', but is produced by the insulated conductor structure which produced the characteristic of curve 'B'.

As may be seen from FIG. 3, in the insulated conductor structure, then for any chosen solid layer percentage of total insulation thickness, the dielectric strength for curve 'A' is far superior to that of curve 'B'. On the other hand, as shown by FIG. 4, the outside diameter of the total insulation of the structure for curve 'C' is greater than for curve 'D' for a given solid layer percentage of total insulation thickness. While this may appear to show a disadvantage in constructions of cable having insulated conductors which produce curve 'C' compared to those insulated conductors having the outer layer as a solid layer according to U.S. Pat. No. 4,058,669, such is not the case. In order to be able to achieve a true comparison between the two insulated structures for air-core cable, FIGS. 3 and 4 need to be interrelated.

It is a requirement of the present invention that while achieving 83 nanofarads/mile as a nominal mutual capacitance, the dielectric strength between insulated conductors should be at least twice the minimum which is required by North American specifications. This minimum value for 22 AWG conductor is 8 Kv. On curve 'A', this minimum is satisfied by an insulated conductor in air-core cable according to the invention when the solid layer thickness is approximately 8% of the total insulation thickness as shown by position 24 on curve 'A'. An acceptable average dielectric strength of 16 Kv is produced with a solid layer thickness of approximately 23% of the total thickness of the insulation. This percentage shown at position 25 on curve 'A' corresponds appoximately to a thickness of 2 mil for the inner solid layer of insulation. As may be seen in curve 'C' in FIG. 4, the 23% position for solid layer thickness is at position 26. At this position, the outside diameter of insulated conductor in air-core cable according to the invention is at, or slightly below, 92% of the outside diameter of conductor having a single solid layer.

If the same exercise is now performed upon curves 'B' and 'D' for insulated conductor according to U.S. Pat. No. 4,058,669, the following is found.

To achieve a dielectric strength between insulated conductors of 16 Kv on curve 'B', as shown at position 28, then a solid insulation layer of approximately 65% of the total insulation thickness is required. This percentage of solid insulation when applied to curve 'D', on FIG. 4 results in an outside diameter of approximately 95.5% of the outside diameter of a single solid layer of insulation (position 30 on curve 'D').

In summary, to achieve a nominal 83 nanofarads/mile mutual capacitance in air-core cable according to the invention with 25% blow in the cellular layer, each conductor needs insulation having an inner solid layer with a minimum of 2 mil thickness to achieve an acceptable dielectric strength of 16 Kv. between conductors. This is produced with an outside diameter over the insulation which is reduced by about 8% below that of completely solid insulation. In contrast and to achieve the same mutual capacitance in air-core cable using conductors as described in U.S. Pat. No. 4,058,669 and with 25% blow, a solid insulation layer would need to be about 5.6 mil in thickness and the outside diameter reduction would only be about 5% below that of a completely solid insulation.

If the percentage blow is increased in both constructions, then curve 'A' for constructions within the scope of the invention changes its characteristic until it reaches the position of curve 'E' for 50% blow. Similarly, curve 'B' changes and becomes curve 'F' for 50% blow.

For 50% blow and to achieve 83 nanofarads/mile nominal mutual capacitance, the thickness of the solid insulation layer in conductors in air-core cable according to the invention need be only about 27% of the total insulation thickness to achieve the acceptable dielectric breakdown between conductors of 16 Kv. This is shown by position 32 on curve 'E'. The corresponding position 34 on curve 'G' in FIG. 4 occurs at a diameter of about 85% of the diameter of a single solid layer of insulation i.e. a reduction of 15%. In comparison with this, the acceptable dielectric strength between conductors on curve 'F' is with the use of a solid layer which is approximately 87% of the total insulation thickness. This is shown at position 36. This corresponds to position 38 on corresponding curve 'H' in FIG. 4. At this position, the outside diameter of the insulation is about 96% of that for the single solid insulation layer for 22 AWG conductor.

Significantly, graphs 'C' and 'G' indicate that in the inventive structure of air-core cable, the diameter of the insulation reduces drastically as the percentage blow increases to achieve the acceptable dielectric strength at 83 nanofarads/mile. In contrast, a slight increase occurs in the alternative and known structure represented by graphs 'D' and 'H'. These advantages in diameter commence at a blow of about 15%. At this position, the outside diameter over the insulation of structures according to the invention is slightly less than for the prior art structures also having 15% blow and as discussed with regard to FIGS. 3 and 4. The chosen structure with 25% and 50% blow are merely illustrative and clearly indicate the advantageous trend. The percentage blow may be increased so far as is practical.

Thus, the above comparison of and interrelation of the graphs illustrates that distinct advantages may be obtained with an air-core cable having each conductor with a solid (non-cellular) inner layer and a cellular outer layer if the blow in the cellular layer is at least 15% and if the inner layer has a thickness of at least 2 mil when satisfying the criteria of 83 nanofarads/mile mutual capacitance. This results in a satisfactory dielectric strength between conductors while reducing the outside diameter of the insulation significantly below that for a single solidly layered conductor, thereby enabling a significant reduction in the outside cable diameter. In addition to this, significant savings in insulating material are obtained as the solid layer is a small proportion (i.e. down to approximately 23%) of the thickness of the total insulation. No other manner of insulating conductor for air-core cable can possibly achieve these results. These advantages are found particularly when the thickness of the solid layer lies between 23% (as discussed) and 46% of the total insulation thickness. Thus a preferrred upper solid layer thickness in insulation in the inventive structures is approximately 4 mil.

For other gauges of conductor, curves for the inventive structure and the prior art structure would be related similarly to those shown in FIGS. 3 and 4 and the advantages which have already been discussed would be found with those gauges.

In the following test to determine dielectric strengths of conductors and between conductors of air-core cable, measurements were taken of the dielectric strengths of insulated conductor according to the above-described embodiment for 22 AWG conductor. These appear in "Category A" of the following Table 1.

For comparison, the test also includes measurements of dielectric strengths for air-core cable of insulated conductors which were made for grease filled cable and in which the insulation has an inner cellular layer of polypropylene and an outer non-cellular layer of medium density polyethylene and as described in the above Canadian Pat. No. 952,991 or in U.S. Pat. No. 4,058,669. These are shown under "Category B" in Table 1.

In addition, and also for comparison, the test includes measurements of dielectric strengths of insulated conductors as normally used in air-core cable and in which the conductor insulation is conventional and is non-cellular low density polyethylene throughout (i.e. solid). These measurements appear as "Category C".

ues (Kv), recorded for all of the thirty-three 30 foot sample lengths tested, are recorded in Table I together with the average breakdown figure. The above test procedure was then repeated for another 1000 foot length of conductor in Category 'A' which had been insulated on a different production run ("2" in Table I) and the results similarly recorded.

The test procedure was then performed for 30 foot sample lengths of two twisted together insulated conductors, in water in which conductor "1" was twisted with conductor "2". Results are given under column 3. In this test the water is insulated from ground with one conductor connected to the electrical power source and the other to ground.

The whole of the above procedure was then repeated for two 1,000 foot lengths of insulated conductor made under Category 'B' and dielectric breakdown values given under columns 4, 5 and 6. Column 6 relates to the twisted together conductors.

Under Category 'C', tests were made and breakdown values given under columns 7 and 8. No test was performed under Category 'C' for the insulated conductors twisted together.

TABLE I

| | | CATEGORY A | | | CATEGORY B | | | CATEGORY C | |
|---|---|---|---|---|---|---|---|---|---|
| | SAMPLE | 1 | 2 | 3 | 4 | 5 | 6 | 7 | 8 |
| d.c. Voltage Dielectric Breakdown (Kv) | Average | 15.2 | 15.1 | 29.4 | 10.5 | 15.3 | 17.5 | 36 | 48 |
| | Minimum | 11.5 | 11.0 | 22.0 | 8.5 | 4.0 | 8.0 | 12 | 27 |
| | Maximum | 17.0 | 16.5 | 32.5 | 13.0 | 22.0 | 19.0 | 46 | 60 |
| Outside Diameter of Insulation (mils) | | 43.3 | 42.7 | — | 48.0 | 48.0 | — | 45.5 | 44.8 |
| Thickness in mils of Cellular Layer as:- | | | | | | | | | |
| i/. outer layer | | 6.7 | 6.4 | N/A | — | — | | | |
| ii/. inner layer | | — | — | | 8.7 | 8.3 | N/A | | |
| Thickness in mils of Non-Cellular Layer as:- | | | | | | | | | |
| i/. outer layer | | | | | 2.6 | 3.0 | N/A | | |
| ii/. inner layer | | 2.3 | 2.3 | N/A | | | | | |
| aii/. whole layer | | | | | | | | 10.1 | 9.7 |

The test was conducted while submerging the insulated conductors concerned under water. This was done to simulate the worst possible conditions which insulated conductors in an air-core cable could experience, i.e. conditions in which the core is completely waterlogged. It should be stressed that these conditions should not normally be expected for air-core cable but are ones which could lead to premature dielectric breakdown.

A 1000 foot length of insulated conductor in Category 'A' and insulated on one production run ("1" in Table I) was tested in 30 foot sample lengths. Each sample length was immersed in water connected to ground and a d.c. potential passed through it. The voltage was increased at a substantially uniform rate with voltage at each value applied for 3 seconds. This procedure was followed until dielectric breakdown occurred. The maximum and minimum dielectric breakdown val- In the above table, "N/A" appears where thickness measurements are not applicable to twisted together conductor columns 3 and 6.

It should be stressed at this stage that the insulated conductors in Category 'B' were designed for grease filled cable. The desired mutual capacitance of 83 nanofarads/mile would not be achieved between conductors of this construction for air-core cable. However, in contrast, conductors in both of Categories 'A' and 'C' have a nominal mutual capacitance of 83 nanofarads/mile for air-core cable.

As may be seen from the above Table I, the average dielectric breakdown values for conventionally insulated conductor (Category 'C') were consistently very high with very high average breakdown values of 36 Kv and 48 Kv. While the breakdown values for insulated conductors according to the embodiment described above were much lower than those of Category C, these values for the embodiment are extremely satisfactory (Category A) and are significantly above the minimum requirement of 8 Kv d.c. for commercially acceptable air-core cable. Column 3 shows these breakdown values between conductors for Category 'A'. The minimum is 22 Kv d.c. which is well above the requirement of 8 Kv d.c. Column 3 results are interesting in that they indicate values approximately twice those obtained for the single wires in columns 1 and 2. This doubling in values between conductors illustrates not only that current needed to pass through two layers of insulation on both conductors (as distinct from two layers on one conductor in columns 1 and 2), but also that the inner insulation layers of solid material were adding their dielectric strength characteristics without these being degraded by flaws in the layers. This illustrates that there were no physical stresses causing flaws in the inner layers and no impurities, e.g. color pigments in the layers, both of which would tend to deleteriously affect the results obtained. As a means of comparison with Category 'B', it may be seen that the dielectric breakdown values in column 6 are certainly not of the order of double those obtained for single conductors in columns 4 and 5. In fact, they are not significantly different from columns 4 and 5. It is believed that the lack of the doubling value effect in column 6 can be blamed upon physical stresses imposed by the inner cellular layers, during extrusion upon the outer solid layers of Category 'B' construction, whereby flaws and pinholes are formed, and upon the use of color pigmentation in these outer layers.

Hence, the dielectric strength between conductors for the Category 'A' construction is significantly higher than for the Category 'B' construction. It should be remembered that Category 'B' insulated conductor was made for grease filled cable and would have a dielectric strength suitable for this purpose. However, if insulated conductor under Category 'B' were designed for air-core cable while providing the desired nominal 83 nanofarads/mile mutual capacitance and having a diameter less than that of Category 'C', then this would lead to a dielectric strength below that established in the tests by the conductors in Category 'B'.

The results obtained for the construction of the invention were, as already stressed, well above the acceptable levels specified, and there was a significant saving in material compared to the construction of Category 'C', with attendant cost saving. In addition, these commercially acceptable results were obtained with outside diameters of insulation in the Category 'A' construction which were at least 1.5 mils less than the outside diameters of the Category 'C' construction. Hence, it follows that a resultant air-core cable made with insulated conductors according to the invention will have an outside diameter less than one made using conventional insulated conductors as shown by Category 'C' while being more economic and providing well above the commercially acceptable levels of dielectric breakdown between conductors. These tests compare favorably with the curves of FIGS. 3 and 4.

The recorded values in Table I indicate that constructions according to the invention are a desirable replacement for constructions using a single layer of solid material. In the desirable results in Table I, the inner layer thickness approached the minimum of 2 mil according to the invention.

In constructions according to the invention, the amount of air space in the total volume of the outer layer is a parameter in deciding the capacitance whereas the amount of polymeric material is a parameter for the dielectric strength.

The invention is applicable to all conductor gauges which are useful for telecommunications cable and, for all these gauges, that is 19, 22, 24, 26 and 28, i.e. from 0.0126 inches to 0.0360 inches, acceptable dielectric strengths are obtainable with thicknesses of between 2 and 4 mils for the non-cellular inner layer.

We claim:

1. A telecommunications cable having an air-core in which a plurality of insulated electrical conductors are provided, each of which comprises a conductor of diameter between 0.0126 inch and 0.0360 inch having insulation comprising an unpigmented inner layer of solid non-cellular polyolefin based composition of at least 2 mils thick, and an outer layer of cellular polyolefin based composition wherein the cells provide an air space which is at least 15% of the total volume of the outer layer and wherein the nominal mutual capacitance between conductors is at 83 nanofarads/mile and a predetermined dielectric breakdown value between conductors is obtained, the maximum outside diameter across the insulation being less than that of an electrical conductor of equal conductor diameter which provides the same nominal mutual capacitance with a solid non-cellular insulation of the same material as said inner layer.

2. A cable according to claim 1 wherein the cells provide an airspace of at least 25%.

3. A cable according to claim 1 wherein the outer layer has closed cells.

4. A cable according to claim 1 wherein the inner layer is from 2 mils to 4 mils thick.

* * * * *